US005554259A

United States Patent [19]

Gandek et al.

[11] Patent Number: 5,554,259

[45] Date of Patent: Sep. 10, 1996

[54] REDUCTION OF SALT SCALE PRECIPITATION BY CONTROL OF PROCESS STREAM PH AND SALT CONCENTRATION

[75] Inventors: Thomas P. Gandek, Trenton, N.J.; James C. Joseph, Yardley, Pa.; Michael A. Pikulin, Bound Brook; George Pangalos, Plainsboro, both of N.J.; Philip E. Bowden, Franklin, Va.

[73] Assignee: Union Camp Patent Holdings, Inc., Wayne, N.J.

[21] Appl. No.: 130,619

[22] Filed: Oct. 1, 1993

[51] Int. Cl.[6] ..... D21C 9/08; D21C 9/153

[52] U.S. Cl. ..... 162/48; 162/65; 162/DIG. 8

[58] Field of Search ..... 162/48, 90, 29, 162/181.3, 181.4, 181.2, 43, 199, DIG. 4, DIG. 8, 65

[56] References Cited

U.S. PATENT DOCUMENTS

| | | |
|---|---|---|
| 1,591,070 | 7/1926 | Wolf . |
| 1,642,978 | 9/1927 | Thorne . |
| 1,643,566 | 9/1927 | Thorne . |

(List continued on next page.)

FOREIGN PATENT DOCUMENTS

| | | |
|---|---|---|
| 880441 | 8/1992 | Australia . |
| 966604 | 4/1975 | Canada . |
| 970111 | 7/1975 | Canada . |
| 1103409 | 6/1981 | Canada . |
| 1112813 | 11/1981 | Canada . |
| 1119360 | 3/1982 | Canada . |
| 1132760 | 10/1982 | Canada . |
| 1154205 | 9/1983 | Canada . |
| 1164704 | 4/1984 | Canada . |
| 1181204 | 1/1985 | Canada . |
| 1186105 | 4/1985 | Canada . |
| 2017807 | 12/1990 | Canada . |
| 2067844 | 3/1992 | Canada . |
| 062539 | 10/1982 | European Pat. Off. . |
| 106460 | 4/1984 | European Pat. Off. . |
| 106609 | 4/1984 | European Pat. Off. . |
| 276608 | 8/1988 | European Pat. Off. . |
| 0308314 | 3/1989 | European Pat. Off. . |
| 0402335 | 12/1990 | European Pat. Off. . |
| 0492040A1 | 7/1992 | European Pat. Off. . |
| 0492039A1 | 7/1992 | European Pat. Off. . |
| 0512590A1 | 11/1992 | European Pat. Off. . |
| 0520140A1 | 12/1992 | European Pat. Off. . |
| WO88/03095 | 7/1988 | WIPO . |

OTHER PUBLICATIONS

James P. Casey, "Pulp & Paper, Chemistry & Chemical Technology", 3rd ed., vol. 1, 1980, pp. 728–731.

Abrahanson and Samuelson, "Oxygen/Sodium Carbonate Bleaching of Kraft Pulp Pretreated with Nitrogen Dioxide and Oxygen", Svensk Papperstidning (1983).

Allison, R. W., "Efficient Ozone and Peroxide Bleaching of Alkaline Pulps From Pinus Radiata," *Appita*, vol. 36, No. 1 (Jul. 1982) p. 42.

Article, "Naco Straw Pulp", PPI, (Apr. 1987).

Agrawal et al., "Performance of Trough–Paddle Mixing Conveying System for Treatment of Wheat Straw with Small Volumes of Liquids,"*p. 18.*

(List continued on next page.)

*Primary Examiner*—Donald E. Czaja
*Assistant Examiner*—Dean T. Nguyen
*Attorney, Agent, or Firm*—Pennie & Edmonds

[57] ABSTRACT

A method for reducing or eliminating the formation of salt scale upon process equipment caused by precipitation of salts during the bleaching of pulp. The pulp is subjected to a bleaching sequence which includes a plurality of pulp treatment steps, wherein at least one pulp treatment step is conducted under alkaline conditions and at least one pulp treatment step is conducted under acidic conditions. A filtrate stream which contains dissolved salts therein is thus generated, and at least a portion of the filtrate stream is combined with an alkaline stream and pulp to cause the salts to associate with the pulp, thus removing the salts from the filtrate stream to reduce or eliminate the formation of salt scale upon process equipment during the bleaching of the pulp.

43 Claims, 1 Drawing Sheet

U.S. PATENT DOCUMENTS

| | | | |
|---|---|---|---|
| 1,818,913 | 8/1931 | Van De Carr, Jr. . | |
| 1,860,432 | 5/1932 | Richter . | |
| 1,957,937 | 5/1934 | Campbell et al. . | |
| 2,013,115 | 9/1935 | Thorne | 8/2 |
| 2,057,059 | 11/1935 | Rue | 162/83 |
| 2,431,478 | 11/1947 | Hill | 8/156 |
| 2,466,633 | 4/1949 | Brabender et al. | 8/104 |
| 2,926,114 | 2/1960 | Grangaard et al. | 162/16 |
| 2,975,169 | 3/1961 | Cranford et al. | 260/212 |
| 3,024,158 | 3/1962 | Grangaard et al. | 162/17 |
| 3,251,730 | 5/1966 | Watanabe | 162/56 |
| 3,274,049 | 9/1966 | Gaschke et al. | 162/65 |
| 3,318,657 | 5/1967 | Wade | 8/111 |
| 3,384,533 | 5/1968 | Meylan et al. | 162/65 |
| 3,423,282 | 1/1969 | Rerolle et al. | 162/65 |
| 3,451,888 | 6/1969 | Ancelle et al. | 162/65 |
| 3,462,344 | 8/1969 | Kindron et al. | 162/72 |
| 3,630,828 | 12/1971 | Liebergott et al. | 162/24 |
| 3,652,388 | 3/1972 | Croon et al. | 162/65 |
| 3,660,225 | 6/1972 | Verreyne et al. | 162/17 |
| 3,663,357 | 5/1972 | Liebergott | 162/65 |
| 3,703,425 | 11/1972 | Schleinofer | 162/17 |
| 3,725,193 | 6/1973 | De Montigny | 162/17 |
| 3,740,310 | 6/1973 | Smith et al. | 162/65 |
| 3,759,783 | 9/1973 | Samuelson et al. | 162/40 |
| 3,785,577 | 1/1974 | Carlsmith | 241/57 |
| 3,814,664 | 6/1974 | Carlsmith | 162/236 |
| 3,832,276 | 8/1974 | Roymoulik et al. | 162/65 |
| 3,874,992 | 4/1975 | Liebergott | 162/66 |
| 3,888,727 | 6/1975 | Kenig | 162/65 |
| 3,926,798 | 12/1975 | Cadotte | 210/23 |
| 3,951,733 | 5/1976 | Phillips | 162/65 |
| 3,962,029 | 6/1976 | Wettermark et al. | 162/49 |
| 3,964,962 | 6/1976 | Carlsmith | 162/236 |
| 4,046,621 | 9/1977 | Sexton | 162/40 |
| 4,080,249 | 3/1978 | Kempf et al. | 162/57 |
| 4,089,737 | 5/1978 | Nagano et al. | 162/19 |
| 4,093,506 | 6/1978 | Richter | 162/17 |
| 4,119,486 | 10/1978 | Eckert | 162/65 |
| 4,120,747 | 10/1978 | Sarge, III et al. | 162/117 |
| 4,123,317 | 10/1978 | Fritzvold et al. | 162/17 |
| 4,155,806 | 5/1979 | Mannbro | 162/19 |
| 4,155,845 | 5/1979 | Ancelle et al. | 210/22 R |
| 4,158,597 | 6/1979 | Petersson | 162/238 |
| 4,198,266 | 4/1980 | Kirk et al. | 162/29 |
| 4,216,054 | 8/1980 | Bentvelzen et al. | 162/57 |
| 4,220,498 | 9/1980 | Prough | 162/25 |
| 4,226,673 | 10/1980 | Fremont | 162/29 |
| 4,229,252 | 10/1980 | Meredith | 162/65 |
| 4,248,662 | 2/1981 | Wallick | 162/19 |
| 4,259,150 | 3/1981 | Prough | 3/81 |
| 4,268,350 | 5/1981 | Mansson | 162/29 |
| 4,272,918 | 6/1981 | Zilka | 162/237 |
| 4,274,913 | 6/1981 | Kikuiri et al. | 162/65 |
| 4,278,496 | 7/1981 | Fritzvold | 162/19 |
| 4,279,694 | 7/1981 | Fritzvold et al. | 162/28 |
| 4,283,251 | 8/1981 | Singh | 162/17 |
| 4,295,925 | 10/1981 | Bentvelzen et al. | 162/19 |
| 4,295,926 | 10/1981 | Bentvelzen et al. | 162/57 |
| 4,298,426 | 11/1981 | Torregrossa | 162/57 |
| 4,298,427 | 11/1981 | Bentvelzen et al. | 162/57 |
| 4,363,697 | 12/1982 | Markham et al. | 162/19 |
| 4,372,812 | 2/1983 | Phillips | 162/40 |
| 4,384,920 | 5/1983 | Markham et al. | 162/19 |
| 4,426,256 | 1/1984 | Johnsen | 162/237 |
| 4,431,480 | 2/1984 | Markham et al. | 162/19 |
| 4,435,249 | 3/1984 | Markham et al. | 162/24 |
| 4,439,271 | 3/1984 | Samuelson | 162/19 |
| 4,444,621 | 4/1984 | Lindhal | 162/26 |
| 4,450,044 | 5/1984 | Fritzvold et al. | 162/65 |
| 4,451,332 | 5/1984 | Annergren et al. | 162/30.1 |
| 4,459,174 | 7/1984 | Papageorges et al. | 162/40 |
| 4,468,286 | 8/1984 | Johnsen | 162/17 |
| 4,563,243 | 1/1986 | Koch et al. | 162/18 |
| 4,568,420 | 2/1986 | Nonni | 162/65 |
| 4,595,455 | 6/1986 | Mannbro | 162/38 |
| 4,640,782 | 2/1987 | Burleson | 210/748 |
| 4,818,339 | 4/1989 | Lamort | 162/4 |
| 4,840,703 | 6/1989 | Malmsten | 162/49 |
| 5,039,314 | 8/1991 | Lehner et al. | 55/26 |
| 5,096,539 | 3/1992 | Allan | 162/9 |
| 5,164,043 | 11/1992 | Griggs et al. | 162/57 |
| 5,164,044 | 11/1992 | Griggs et al. | 162/57 |
| 5,188,708 | 2/1993 | Griggs et al. | 162/40 |
| 5,211,811 | 5/1993 | Griggs et al. | 162/40 |
| 5,217,574 | 6/1993 | Griggs | 162/19 |
| 5,290,454 | 3/1994 | Dorica et al. | 210/710 |
| 5,352,332 | 10/1994 | Maples et al. | 162/30.1 |
| 5,401,362 | 3/1995 | Lindberg | 162/37 |

OTHER PUBLICATIONS

Allison, R. W., "Effect of Ozone on High–Temperature Thermomechanical Pulp", *Appita,* vol. 32, No. 4 (Jan. 1979) p. 279.

Allison, Production of Bleached Softwood Pulp by Low Pollution Processes, Wood Sci. Technol. 17, pp. 129–137 (1983).

Andtbacka, "Low Kappa Pulping Followed by Oxygen Delignification", Appita, vol. 39, No. 2, (1986).

Backlund, A., "A Progress Report on Continuous Digester Development", Paper Presented to the 21st EUCEPA International Conference–Torremolinos, Spain.

Balousek, "The Effects of Ozone Upon Lignin Model Containing the B–aryl Ether Linkage", Svensk Papperstidning, No. 9, 1981.

Byrd, Jr., Medwick V., "Delignification and bleaching of chemical pulps with ozone: a literature review", TAPPI Journal, Mar. 1992.

Brannland and Fossin, "How to Cope With TOCL", International Oxygen Delignification Conference, (1987).

Britt, "Pulp and Paper Technology".

Casey, J. P., "Bleaching: A Perspective", *TAPPI Journal,* vol. 66, No. 7 (Jul. 1983) p. 95.

Carlberg et al., "Bleaching of Sulphite and Sulphate Pulps Using Conventional and Unconventional Sequences", TAPPI Proceedings 1982 Annual Meeting, p. 381.

Chapter 6–Sulfite Pulping, Handbook for Pulp & Paper Technologists (TAPPI).

Chapter 7–Kraft Pulping, Handbook for Pulp & Paper Technologists (TAPPI).

Chapter 11–Bleaching, Handbook for Pulp & Paper Technologists (TAPPI).

Christenson, P. K., Bleaching of Sulphate Pulps with Hydrogen Peroxide: III. Bleaching of Oxygen Bleached Pulps, *Norsk Skogindustri* (Oct. 1973) p. 268.

DeSousa et al., "The Influence of Chlorine Ratio and Oxygen Bleaching on the Formation of PCDF's and PCCD's in Pulp Bleaching", Tappi Journal (Apr. 1989).

Dyck, A. W. J., "New Advances in Mechanical Pulping", *American Paper Industry* (Sep. 1971) p. 21.

Eickeler, "Ozone Measurement with Detector Tubes".

Elton et al., "New Technology for Medium–Consistency Oxygen Bleaching".

Eriksson and Gierer, "Ozonation of Residual Lignin".

Fossum et al., "Final Bleaching of Kraft Pulps Delignified to Low Kappa Number by Oxygen Bleaching", Tappi Journal pp. 60–62, (Dec. 1983).
Fujii et al., "Oxygen Pulping of Hardwoods," TAPPI, Alkaline Pulping/Secondary Fibers Conference (Washington, D.C., Nov. 7–10, 1977).
Gangolli, "The Use of Ozone and Pulp in the Paper Industry".
Geiger, "Mechanisms of Bleach with Oxygen–Containing Species", ISWPC, (1987).
Gellerstedt et al., "Singlet Oxygen Oxidation of Lignin Structures," *Singlet Oxygen,* Chapter 31, pp. 302–310, (Sep. 1976).
Germgard, "Chlorate Discharge from Bleach Plants—How to Handle a Pontential Environmental Problem", Paperi ja Puu, V. 71, No. 3, (1989).
Germgard et al., "Mathematical Models for Simulation and Control of Bleaching Stages," Nordic Pulp and Paper Research Journal, No. 1 (1987).
Germgard and Sjogren, "Ozone Prebleaching of a Modified–Cooked and Oxygen–Bleached Softwood Kraft Pulp", Svensk Papperstidning, No. 15, (1985).
Gierer, "Chemistry of Delignification, Part 2: Reactions of Lignins During Bleaching", World Science and Technology (1986).
Godsay and Pearce, "Physico–Chemical Properties of Ozone Oxidized Kraft Pulps", Oxygen Delignification (1984).
Grant, R. S., Displacement Heating Trials with a New Process to Reduce Steam, *TAPPI Journal* (Mar. 1983) p. 120.
Gregor and Gregor, "Synthetic—Membrane Technology", Scientific American, (Jul. 1978).
Gupta, et al., OZ Prebleaching, Influence on Viscosity and Sheet Strength, TAPPI Symposium–Oxygen Delignificatioin, p. 1 (1984).
Heimburger et al., Kraft Mill Bleach Plant Effluents: Recent Developments Aimed at Decreasing Ther Environmental Impact.
Heimburger et al., Kraft Mill Bleach Plant Effluents: Recent Developments Aimed at Decreasing Their Environmental Impact, Part II, TAPPI Journal, p. 69 (Nov. 1988).
Hill and Rice, "Handbook of Ozone Technology and Applications", Ann Arbor Science.
Hiraoka et al., "Two Dimensional Model Analysis of Turbulent Flow Behavior of Highly Viscous Non–Newtonian Fluid in Agitated Vessel with Paddle Impeller," Journal of Chemical Eng. of Japan, p. 56.
Hiraoka et al., "Two Dimensional Model Analysis of Turbulent Flow in an Agitated Vessel With Paddle Impeller, Chem. Eng. Commun.," p. 149.
Jamieson and Smedman, "Integration of Oxygen Bleaching in the Brown Stock Washing System", Svensk Papperstidning (1973).
Katai and Schuerch, "Mechanism of Ozone Attack on Alpha–Methyl Glucoside and Cellulosic Materials".
Kortelainen, V. A. et al., Experiences with Extended Delignification of Hardwood and Softwood Kraft Pulp in a Continuous Digester, *TAPPI Journal,* (Nov. 1985) p. 70.
Kratzl et al., "Reactions of Lignin and Lignin Model Compounds With Ozone", *Tappi,* vol. 59, No. 11 (Nov. 1976) p. 86.
Kirk et al., "Low Consistency Oxygen Delignification in a Pipeline Reactor," TAPPI, vo. 61, No. 5.
Kibblewhite et al., "Effects of Ozone on the Fibre Characteristics of High–Temperature Thermomechanical Pulp", Proceedings of the 1979 International Mechanical Pulping Conference, p. 293.
Klein, et al., Delignifying Bleaching of Sulfite Pulps with Hydrogen Peroxide, EUCEPA Conference Report (Jun. 1980).
Leopold, B., "The Pulping Process—Opportunity or Headache?", Proceedings of IPC Conference, Paper Science and Technology, May 8–10, 1979.Leopold, B., "The Pulp Mill of the Future", *Textile and Paper Chemistry and Technology,* p. 239.
Liebergott et al., "The use of Ozone or Oxygen in the First Bleaching Stage", *Ozone: Science and Engineering,* vol. 4, p. 109 (1982).
Liebergott, n., "Paprizone Process for Brightening and Strengthening Groundwood", *Paper Trade Journal* (Aug. 2, 1971) p. 28.
Liebergott, n., Techanical Paper T214—"Sequential Treatment of Mechanical Pulps at High Consistency with $H_2O_2$ and $O_3$—The Paprizone Process–Effect on Pulp Brightness and Strength", *Pulp and Paper Magazine of Canada,* vol. 73, No. 9, (Sep. 1972) p. 70.
Liebergott, et al., Bleaching a Softwood Kraft Pulp Without Chlorine Compounds, pp. 1–10.
Liebergott et al., "Ozone Delignification of Bleach Spruce and Hardwood Kraft, Kraft Anthraquinone, and Soda–Anthraquinone", *TAPPI,* vol. 64, No. 6 (Jun. 1981) p. 95.
Liebergott et al., "Comparison Between Oxygen and Ozone Delignification in the Bleaching of Kraft Pulps", TAPPI Proceedings—1981 Pulping Conference, p. 157.
Liebergot, et al., "Rapid press–caustic extraction in pulp bleaching sequences", Pulp and Paper Canada, vol. 79, No. 12, Dec. 1978, p. 105.
Liebergott et al., The Use of Ozone in Bleaching and Brightening Wood Pulps: Part I—Chemical Pulps (TAPPI) 1978).
Norman Liebergott, et al., "A survey of the use of ozone in bleaching pulps, Part 1, TAPPI Journal, Jan. 1992, p. 145.
Norman Liebergott, et al., "A survey of the use of ozone in bleaching pulps, Part 2, TAPPI Journal, Feb. 1992, p. 117.
Lindholm, "Effect of Heterogeneity in Pulp Bleaching With Ozone", Paperi ja Puu, (Apr. 1987).
Lindholm, "Effect of Pulp Consistency and pH in Ozone Bleaching", Paperi ja Puu, (Mar. 1987).
Lindholm, "Effect of Pulp Consistency on pH in Ozone Bleaching, Part 2", International Oxygen Delignification Conference (1987).
Carl–Anders Lindholm, "Alkaline extraction of ozone–bleached pulp", Part 1. Paperi Ja Puu, Paper and Timer, vol. 74/No. 3/1992.
Carl–Anders Lindholm, "Alkaline extraction of ozone–bleached pulp", Part 2., Nordic Pulp and Paper Research No. 2/1992.
Lindquist, et al., "Ozone Bleaching of Sulfite Pulps", TAPPI Proceedings of the 1982 International Sulfite Pulping Conference, p. 127.
Loras et al., "Bleaching of Sulphite Pulps With Oxygen and Ozone", Report of 1982 International Pulp Bleaching Conference, p. 45.
Loras, V., "Bleachability of Mechanical Pulp", *Tappi,* vol. 57, No. 2 (Feb. 1974) p. 98.
Mbachu et al., "The Effect of Acetic and Formic Acid Pretreatment on Pulp Bleaching With Ozone", *TAPPI,* vol. 64 No. 1 (Jan. 1981) p. 67.

McDonough, "Oxygen Bleaching's Pace Quickens", IPC Technical Paper Series, No. 246 (Jul. 1987).
Melnyk et al., "An Ozone Reactor for Color Removal From Pulp Bleachery Wastes," Chemical Abstracts, p. 434.
Meredith et al., "Ozone Mass Transfer Agitated Low Consistency," Wood Pulp, Sept. 9, 1981.
Norden and Simonson, "Ozone Bleaching of Sulphite Pulp—A Pilot Plant Study".
Ohnishi, K., "Japan: Pulping Bleaching", *Pulp and Paper* (Aug. 1978) p. 88.
Ouederni, "Simulation of the Ozone/Lignin Reaction in an Agitated Vessel".
Ow, et al., Advances in Ozone Bleaching: Part II—Bleaching of Softwood Kraft Pulps with Oxygen and Ozone Combination, TAPPI Symposium—Oxygen Delignification (1984).
"Ozone Bleaching of Sulfite Pulps", *Svensk Papperstidning* (Nov. 6, 1984) p. 54.
"Ozone Bleaching Has Potential For Closing Pulp Mill Water Systems", *Pulp & Paper* (Jul. 1978) p. 76.
Patridge, H., "An Overview of New Pulp Bleaching Developments" AIChE National Meeting, Paper No. 24a (Sep. 7–10, 1975).
Partridge, H., "New Pulp Bleaching Developments", *CEP* (Jun. 1976).
Patt, et al., Use of Ozone For Pulp Bleaching, Papier, 42 (10A), V 14–23 (1988).
Perkins et al., Advances in Ozone Bleaching—Part III—Pilot Plant Installations and Proposed Commercial Implementation.
Pattersson, B. et al., Advances in Technology Make Batch Pulping as Efficient as Continuous, *Pulp and Paper* (Nov. 1985) p. 90.
"Pilot Scale Research at PFI", *Norsk Skogindustri,* (Oct. 1980) p. 228.
Procter, A. R., "Ozone for Treatment of High Kappa Kraft Pulps", *Pulp and Paper Magazine of Canada,* vol. 75, No. 6 (Jun. 1974) p. 58.
Reeve and Earl, "Chlorinated Organic Matter in Bleached Chemical Pulp Production Part 1: Environment Impact and Regulations of Effluents, Pulp and Paper Canada", 90:4, (1989).
Rothenberg, S., et al., Bleaching of Oxygen Pulps with Ozone, *TAPPI Journal* (Aug. 1975) p. 182.
Rothenberg et al., "Ozone Bleaching of Oxygen Pulp", Proceedings of the 1982 Pulping Conference, p. 341.
Rothenberg et al., "Bleaching of Oxygen Pulps with Ozone," TAPPI Journal (Aug. 1975), p. 175.
Rutkowski et al., "Investigations on Bleaching of Sulphate Pine Pulp With Ozone", *Cellulose Chem. Technol.,* vol. 18 (1984) p. 323.
Sarkanen, et al., Chlorination–Free Doxy Bleaching Process for Kraft Pulps.
Saul, C. M., "Chemical Pulp: Its Status and Future", *Appita,* vol. 32, No. 5 (Mar. 1979) p. 345.
Schuerch, "Ozonization of Cellulose and Wood", Journal of Polymer Science, No. 2 (1963).
Secrist et al., "Kraft Pulp Bleaching, II. Studies on the Ozonation of Chemical Pulps", *TAPPI,* vol. 54, No. 4 (Apr. 1971) p. 581.
Secrist et al., "Studies on the Ozonation of Chemical Pulps," p. 215.
Seifert et al., "Engineering Considerations in the Design of Oxygen Reactors," p. 309.
Singh, "The Bleaching of Pulp," TAPPI Press, 3rd Edition.
Singh, Advances in Ozone Bleaching—Part I: The Ozone Bleaching Process—Laboratory to Pilot Plant.
Singh, Ozone Replaces Chlorine in the First Bleaching Stage: Advances in Ozone Bleaching–Part I, TAPPI Journal, p. 45 (Feb. 1982).
Soteland, N., Bleaching of Chemical Pulps with Oxygen and Ozone, *Norsk Skogindustri* (Sep. 1978) p. 199.
Soteland, N., "Bleaching of Chemical Pulps With Oxygen and Ozone", Pulp and Paper Magazine of Canada, vol. 75, No. 4 (Apr., 1974), p. 91.
Soteland, N. "The Effect of Ozone on Mechanical Pulps", *Pulp and Paper Magazine of Canada,* vol. 78, No. 7 (Jul. 1977) p. 45.
Soteland, N., "The Effect of Ozone on Mechanical Pulps", Extended Abstracts of 1976 Canadian Wood Chemistry Symposium, p. 13.
Soteland, Comparison Between Oxygen and Ozone Delignification of Sulphite Pulps, TAPPI Symposium—Oxygen Delignification, p. 71 (1984).
Talka and Priha, "Fractionation and Identification of Some Biologically Active Compounds in Bleached Kraft Mill Effuents", Paperi ja Puu (1987).
Tenda et al., "Mixing Characteristics and Optimum conditions of a Horizontal Gas–Solid Agitated Vessel With Paddle–Blades on Double Parallel Axes," Kogaku, pp. 1–15.
Tritschler and Shelton, "Commercial Manufacture and Industrial Use of Ozone and and Oxident".
Vidal and Molinier, "Ozonolysis of Lignin—Improvement of In Vitro Digestibility of Poplar Sawdust", Biomass 16, (1988).
Voss et al., "Some New Insights Into the Origins of Dioxins Formed During Chemical Pulp and Paper Canada, 89:12 (1988).
Winardi et al., "Pattern Recognition in Flow Visualization Around a Paddle Impeller," Journal of Chemical Engineering of Japan, pp. 503–508.
Wong et al., "Toxicity, BOD and Color of Effluents From Novel Bleaching Processes", *Pulp and Paper Magazine of Canada,* vl. 79, No. 7 (Jul. 1978) p. 41.
A. Rosen, "Adsorption of Sodium Ions on Kraft Pulp Fibers During Washing, TAPPI, vol. 58, No. 9, Sep. 1975 pp. 156–161.
D. Trinh et al., "Sodium Equilibrium in Kraft Pulp Washing", Pulp Paper Sci., vol. 13, No. 3, May 1987, pp. J93–J98.
J. Colodette et a., "Factors Affecting Hydrogen Peroxide Stability in Brightening of Mechanical and Chemimechanical Pulps, Part IV: The Effect of Transition Metals in Norway Spruce TMP on Hydrogen Peroxide Stability", J. Pulp, Paper Sci, vol. 15, No. 3 May, 1989, pp. J79–J83.
J. Colodette et al., "Factors Affecting Hydrogen Peroxide Stability in Brightening of Mechanical and Chemimechanical Pulps, Part III: Hydrogen Peroxide Stability in the Presence of Magnesium and Combinations of Stabilizers", J. Pulp. Paper Sci., Vol. 15, No. 2, Mar., 1989, pp. J45–J51.
J. Colodette et al., "Factors Affecting Hydrogen Peroxide Stability in Brightening of Mechanical and Chemimechanical Pulps, Part II: Hydrogen Peroxide Stability in the Presence of Sodium Silicate", J. Pulp Paper Sci., Vol. 15, No. 1, Jan., 1989, pp. J3–J9.
J. Burton et al., "Hydrogen Peroxide Decomposition by Metal Catalysts: Bad Actors in a Bleaching Stage," Int'l. Symp. Wood & Pulping Chemistry, pp. 255–259.

J. Abbot et al., "The Influence of Metal Ions on Two—Stage Peroxide Bleaching of Radiata Pine TMP", J. Pulp. Paper Sci., vol. 18, No. 2, Mar, 1992, pp. J67–J70.
G. Kutney et al., "Peroxide Bleaching of Mechanical Pulps: Part 2: Alkali Darkening—Hydrogen Peroxide Decomposition", Svensk Paperstidning, No. 9, 1985, R84–89.
J. Abbot et al., "The Influence of Manganese and Magnesium on Alkaline Peroxide Bleaching of Pinus Radiata TMP", APPITA '91, pp. 223–230.
G. Hobbs, "Peroxide Bleaching Under Acidic and Alkaline Conditions: The Role of Transition Metal Ions," 6th ISWPC, pp. 579–586.

REDUCTION OF SALT SCALE PRECIPITATION BY CONTROL OF PROCESS STREAM PH AND SALT CONCENTRATION

TECHNICAL FIELD

The present invention relates to a method for preventing or minimizing the formation of calcium or other insoluble salt precipitates in equipment used for washing and processing pulp during a bleaching sequence where a countercurrent wash water effluent recycle strategy is utilized. Salt scale precipitation is reduced by control of the pH and salt concentration of various process streams and selective association with the pulp fiber.

BACKGROUND OF THE INVENTION

In any bleaching pulp process, filtrate management is an important factor in the overall economy or cost of operation of the process. The water which is used in the process requires both access to a suitable source and treatment of the effluent prior to discharge.

In an effort to reduce the water demand of the process, it is desirable to recycle as much of the effluent as possible. This practice cannot be used with processes utilizing chlorine or multiple steps of chlorine dioxide, since the effluents produced by these processes contain large amounts of chlorides produced by the by-products of such chemicals. Thus, recycling these effluents would cause a build-up of chlorides which, in turn, would cause either corrosion of processing equipment or the use of expensive materials of construction for such equipment. In addition, such effluents require substantial treatment before they can be discharged from the mill, thus requiring further expenditures for equipment and treatment chemicals.

The use of either the conventional CEDED or OC/DED processes results in a significant disposal problem with regard to the effluents produced from the washing steps due to the high levels of chloride-containing compounds found therein. As noted above, these streams cannot be recycled, and are preferably treated before discharge into the environment. Recycling of effluent could be used to decrease the amount of water used, but then the process equipment may be subject to increased corrosion rates due to the increased chloride levels of the recycled effluents.

U.S. Pat. No. 5,164,043 discloses an environmentally improved chlorine-free process for bleaching pulp with oxygen ("O"), ozone ("Z") and then chlorine dioxide ("D") or a peroxide ("P"). A modified oxygen ("$O_m$") stage followed by a modified ozone ("$Z_m$") stage is a preferred delignification sequence. The $O_m$ stage is conducted by reducing the consistency of the pulp to less than about 5%, substantially uniformly combining the pulp with alkaline material, increasing the consistency of the pulp to obtain the desired amount of alkaline material uniformly distributed thereon, and subjecting the pulp to high consistency oxygen delignification. The $Z_m$ stage is conducted by acidifying the pulp, adding a chelating agent, increasing the consistency of the pulp to greater than 20%, and turbulently mixing the pulp at the high consistency with ozone in a dynamic reaction chamber.

The ozone delignified pulp may be subjected to an alkaline extraction stage ("E") and is then brightened by the D or P stage. The use of an $O_mZ_m$ED process, for example, results in the formation of only a minimal amount of chlorinated material in the wash water, which water can be safely discharged, i.e., sewered, within most environmental protection standards. Alternately, this effluent may be treated by reverse osmosis to provide an even cleaner filtrate that may be recycled to previous bleaching stages as shown for further use without the build-up of chlorides.

When a D bleaching stage is desired, steps may be taken to reduce the demand for chlorine dioxide. An $E_o$, $E_p$ or $E_{op}$ step allows the pulp to achieve greater levels of brightness although additional expense is incurred by the use of additional sodium hydroxide and oxygen and/or peroxide in this step. Also, there are known industry procedures for preparing chlorine dioxide whereby residual chlorine levels are minimized (e.g., the R8 process vs. the R3 process). These reduced chlorine level chemicals are preferred for use in the D stage to reduce the chloride levels of the wash water effluent.

Instead of $O_mZ_m$ED, one may use the $O_m$EP process of the invention to obtain additional substantial advantages over the prior art in that no chlorinated compounds whatsoever are produced. This enables all of the effluent to be recycled without experiencing the problems of chloride build-up in the process wash water streams.

As shown in FIG. 4 of the '043 patent, the bleach plant filtrates are recycled countercurrently so that cleaner filtrates are sent back to wash pulp in the earlier (i.e., dirtier) part of the plant in order to achieve a closed or semi-closed filtrate system.

It has now been found that the effluent from the washer downstream of the ozone reactor becomes acidic, primarily due to the relatively low pH conditions of the pulp in the ozone reactor. During typical continuous operation of the $Z_m$ stage, the washer effluent achieves a pH of about 3 to 4 due to the countercurrent flow of alkaline E-stage filtrate. When this washer effluent is recycled to the washer upstream of the ozone stage, the pH of the wash water in that washer drops, calcium, barium and other metals desorb from the pulp and salts of divalent cations such as calcium and barium, and in particular, calcium and barium oxalates, precipitate from the wash water. It has been found that this precipitation generally occurs in the washer, although it can occur in downstream process lines and equipment, such as in the acidification step or the ozone reactor, where it causes operability problems. The extent of scaling can be sufficiently large to cause plugging or blocking of the equipment and require shutdown of the process to remove the precipitated salts. To resolve this problem, it is necessary to reduce the concentration of the divalent cation in this part of the process, or to not recycle the stream that contains it.

It is generally known that concentrations of undesirable ions in a filtrate or effluent stream can be reduced by purging and sewering all or a portion of the stream. Such a practice is not desirable, however, because it increases the water demand for the plant as well as the costs for handling the effluent which is to be discharged from the plant. In addition, this practice would require treatment of the purged stream before it could be properly discharged from the plant. It is also possible to use chelants in sufficient amounts to retain these salts in solution to avoid precipitation, but these additives would be relatively expensive.

Accordingly, what is needed is a method for preventing or controlling precipitation of salts from the wash water effluents or filtrates which are recycled in order to avoid forming substantial amounts of salt scale in process equipment, but without purging or discharging the effluents or filtrates which contain such salts. The present invention provides a simple, yet effective, method for resolving this problem.

SUMMARY OF THE INVENTION

The present invention relates to a method for reducing or eliminating the formation of salt scale upon process equipment caused by precipitation of salts during the bleaching of pulp which comprises: subjecting the pulp to a bleaching sequence which includes a plurality of pulp treatment steps, wherein at least one pulp treatment step is conducted under alkaline conditions and at least one pulp treatment step is conducted under acidic conditions; generating a filtrate stream which contains dissolved salts therein; and combining at least a portion of the filtrate stream with a caustic material and pulp to cause the salts to associate with the pulp, thus removing the salts from the filtrate stream to reduce or eliminate the formation of salt scale upon process equipment during the bleaching of the pulp. For convenience, the caustic material may be an alkaline process stream.

In this method, caustic material may be added to the filtrate stream portion prior to combining the filtrate stream with pulp, since the filtrate stream is generally acidic. Advantageously, the pH of the acidic filtrate stream portion is maintained at at least about 6 before the filtrate stream portion contacts the pulp. Alternatively, the acidic filtrate stream portion may be mixed with pulp and the pH of the mixture raised to at least about 6 to promote salt association with the pulp. If desired, the acidic filtrate stream portion may be neutralized by raising the pH to above about 7 prior to countercurrently recycling the neutralized filtrate.

It is also possible to reduce the concentration of salt cations or anions in the acidic filtrate stream by cocurrently recycling the acidic filtrate stream portion to an alkaline portion of the process. Specifically, the acidic filtrate stream portion may be recycled to an alkaline effluent stream prior to combining the mixture with pulp. Alternatively, the acidic filtrate stream portion may be recycled cocurrently to an alkaline pulp stream to promote salt association with the pulp. These treatments are important because the bleaching sequence is preferably conducted in a closed bleach plant where substantially all wash water effluents or filtrates are countercurrently recycled.

If desired, a diluent stream may be added to the stream which contains the dissolved salts. As noted above, the dissolved salt stream is generally an acidic stream. The diluent stream is preferably one which has a low ion concentration, such as fresh water, stripped condensate or ozone stage filtrate.

According to another aspect of the present process, at least a portion of the acidic filtrate stream is recycled for combining with an alkaline stream and pulp to cause the salts to associate with the pulp leaving the process, thus removing the salts from the filtrate stream to reduce or eliminate the formation of salt scale upon process equipment during the bleaching of the pulp. Generally, the pH of the acidic filtrate stream portion is increased prior to recycling, preferably to at least about 6 by adding caustic material thereto.

Advantageously, the pH of the acidic filtrate stream portion is increased to at least about 7 to neutralize the acidic filtrate portion prior to recycling. This is accomplished by adding caustic material to the washing unit which washes acidic pulp to generate a higher pH filtrate stream causing a larger fraction of the ions to associate with the pulp. Specifically, caustic material can be added to the water used to wash the acidic pulp in the washing unit.

The pH of the acidic filtrate stream portion may instead be increased after recycling, such as by directing the acidic filtrate stream portion to an alkaline effluent stream prior to combining the mixture with pulp, or by directing the acidic filtrate stream portion to an alkaline pulp stream to promote salt association with the pulp. Any alkaline pulp stream that has an alkaline pH and is available in a sufficient quantity to neutralize the acidic filtrate stream portion can be used. The salts generally comprise calcium or barium cations, as well as iron, magnesium, manganese and other ions that are typically present in a pulp stream.

DETAILED DESCRIPTION OF THE INVENTION

Figure 1:
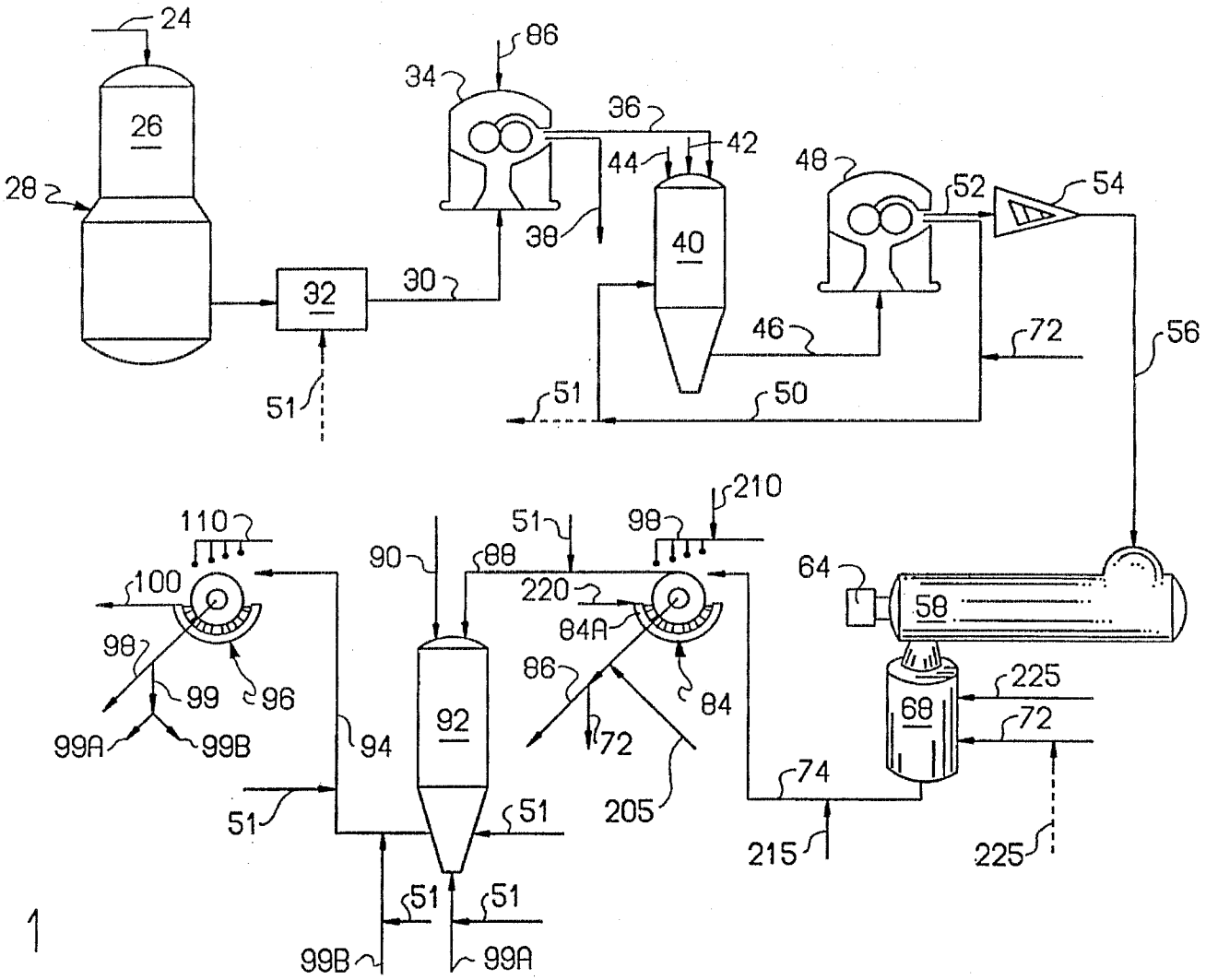
FIG. 1 is a schematic flow diagram of the wash water treatment processes of the present invention.

U.S. Pat. No. 5,164,043 discloses the preferred $O_mZ_mE_oD$ process which is utilized in the present invention. Accordingly, the content of the '043 patent is expressly incorporated herein by reference thereto. FIG. 2 of the '043 patent schematically illustrates the entire bleaching process. For convenience in understanding the present invention and for comparing the present process to that of the '043 patent, like numerals will be used to refer to the equipment and process streams which are the same in each process.

FIG. 1 is a schematic drawing of a portion of the $O_mZ_mE_oD$ process of the '043 patent to illustrate the specific modifications and treatments which are made to the wash water effluents or filtrates.

Calcium, barium and other ions are generally present in all pulp manufacturing processes as naturally occurring elements that enter the process primarily with the wood. These ions typically form salts that have limited solubility and can precipitate in the process when changes occur in concentration, pH or temperature of streams which contain such salts. This is especially true in a closed system where most or all process streams are recycled to minimize the environmental impact of the process, since the amounts of such salts in solution can increase or accumulate over time.

When precipitation of such salts occurs in the absence of pulp fiber, the precipitate manifests itself as a scale or deposit on the metal surfaces of the process equipment, thus reducing the efficiency of or interfering with the proper operation of such equipment. As this scale accumulates, it causes the equipment to become non-functional.

The present invention eliminates or minimizes this problem by controlling the concentration and precipitation of calcium, barium or other salts. In a closed pulp bleaching process, calcium generally precipitates as an oxalate or sulfate salt. Calcium oxalate precipitation will occur when an acid stream containing calcium and oxalate ions undergoes a pH change to the basic side. Calcium sulfate precipitation will generally occur when calcium concentrations in the process stream exceed solubility limits.

Thus, precipitation of salts can be selectively controlled by adjusting pH and ion concentration of the process streams which contain these salts. By causing pH changes of such streams to occur in the presence of pulp fiber, it has been found that precipitated salts and solubilized divalent cations become associated with the pulp fiber and are removed from the system by being physically carried forward with the fiber. In addition, as such salts are removed from the liquid process streams, their concentration in such streams is reduced below the precipitation point. This effectively prevents such salts from depositing or accumulating on or in process equipment, even in a closed pulp bleaching plant where substantially all wash effluents and filtrates are countercurrently recycled.

According to one embodiment of the present invention, an alkaline solution is added to the washer effluent 86 from the washer 84 which is downstream of the ozone reactor 58 before or as such effluent 86 is countercurrently recycled in order to avoid precipitating salts in the equipment to which that effluent is recycled.

It has been found that in order to prevent the formation of scale from the precipitation of divalent cation salts in process equipment to which effluent 86 is recycled, the pH of the effluent 86 must be increased to at least a somewhat neutral or alkaline level. The pH of this stream is usually between 3 and 4 due to the acidity of the pulp in the ozone stage. Specifically, the pH of this stream should be increased to at least 6 and preferably to about 7 or greater. The upper end of the range is not critical and can be as high as 14. In this regard, each pH value (in tenths) between 6.0 and 14.0 inclusive is specifically intended to represent an embodiment of the invention. A most preferred pH range is between about 8 and 11. Then, recycle of the effluent 86 can be made with a portion of the salts retained in solution and the remainder associated with the fiber, thus avoiding precipitation on process equipment. The soluble salts are eventually recycled back to the brownstock washer 12, and ultimately back to the recovery boilers, where they are purged along with other contaminants.

The pH of effluent stream 86 can be increased in a number of ways. The easiest way is to introduce a source of caustic material at one or more points in the process, as shown in FIG. 1. It is to be understood that the term "caustic material" is used broadly in this invention to include any suitable source of alkaline material, and preferably one which contains sodium hydroxide. In a pulping and bleaching plant, there are numerous sources of caustic material, including oxidized white liquor, make-up sodium hydroxide and the like, and any or all of these sources or combinations thereof are suitable for use as caustic material in this invention. Other alkaline streams that can be used as a source of caustic material would include extraction stage filtrate, oxygen stage filtrate and the like. Of course, any plant stream which has an alkaline pH and is available in a sufficient quantity to neutralize the acidic effluent can be used.

As shown in FIG. 1, caustic material 205 may be added directly or indirectly to effluent 86 or to washer 84 so that the solution is maintained at a neutral or alkaline pH. The amount of caustic material to be added is that which is sufficient to raise the pH of the effluent 86 from its usual value (about 1 to 4 and typically about 3 to 4 for the preferred $Z_m$ embodiment) to at least 6 and preferably about 7 or greater, since the other sources of fluid in the washer generally have a pH value above 7. One skilled in the art can easily calculate the appropriate amount of caustic material to be added based on the concentration of the material that is used, the relative amounts of effluent 86 and added caustic and other generally known chemical engineering considerations.

One location where the caustic material may be added is directly to effluent 86 after the effluent exits washer 84. This addition can be simply made by mixing the caustic material 205 into the pipe or conduit which carries effluent 86. When a portion of this effluent is directed to dilution tank 68 (shown as stream 72), the addition of caustic material 205 should be made prior to the takeoff for stream 72. Generally, effluent 86 represents about 87 percent of the total effluent from washer 84, while stream 72 represents about 13 percent of the total effluent.

A second location where the caustic material 210 may be added is to the effluent 98 which is applied to the shower of washer 84 to wash pulp 74 after it has exited the reactor 58. Again, this addition can be made by simply mixing the caustic material 210 into the pipe or conduit which carries effluent 98.

Caustic material 215 may instead be added directly to pulp 74 after it has exited the reactor 58. Again, this addition can be made by simply mixing the caustic material 215 into the pipe or conduit which carries pulp 74. As noted in the '043 patent, the pulp in stream 74 has a low consistency to facilitate movement to subsequent treatment steps. A mixing chest or other appropriate apparatus can be used, if desired, to combine effluent 86, effluent 98 or the low consistency pulp stream 74 with caustic material 205, 210 or 215, respectively.

Alternatively, caustic material 220 may be added to the vat 84A of washer 84 as necessary to raise the pH of the solution therein to the desired range. The amount of caustic material to be added will be that necessary to raise the pH of effluent 86 to above 6 and preferably at least about 7 or greater.

Another way to cause ions to associate with the pulp is to control the pH of the wash effluent 86 is to add caustic material 225 to the dilution tank 68 which is positioned below reactor 58 to receive pulp which has been reacted with ozone. As this vessel is already present, there is no need to add a separate mixing vessel at some other point in the process to introduce the caustic material therein. In effect, the addition of such caustic material to the dilution tank 68 creates an extraction stage which immediately follows the ozone reaction without an intermediate washing step.

This dilution tank 68 receives the acidic pulp and effluent 72 is added to act as an ozone seal and also reduce the consistency of the pulp to facilitate movement of the pulp 74 to subsequent bleaching treatments. Caustic material 225 may instead be added with dilution water 72 or can be added separately, as shown. Of course, adding caustic material 205 to effluent 86 prior to the takeoff of stream 72 avoids the need for the separate addition at line 225.

The pulp residence time in the solution in this tank 68 is about 5 minutes, although depending upon specific operation of the process, this time period can vary from about 1 to 15 minutes. The pH of the pulp and its dilution water 72 are increased to a value which is sufficiently high to maintain effluent 86 at about 7 or above, since this level causes the divalent cations and their salts to associate with the pulp to avoid precipitation and formation of salt scale in wash press 34 or other process equipment.

If desired, various combinations or multiple additions of caustic material can be used provided that the overall increase in pH of the effluent 86 is achieved. Thus, relatively smaller additions of caustic material can be made in multiple locations (i.e., at 205, 210, 215, 220 and 225) to obtain the desired effect.

To avoid the precipitation problems in wash press 34, the entire loop downstream of the ozone reactor 58 is in effect neutralized. Thus, salts associate with the pulp in vessel 68 or in washer 84, rather than precipitate onto the surfaces of such equipment to cause scale build-up. Also, the removal of such salts by association with the fiber reduces the concentration of these salts in the process streams, such as effluent 86, so that when that effluent is recycled countercurrently to wash press 34, a lesser amount of such salts is forwarded to that portion of the system.

According to another embodiment of the present invention, a portion 51 of the acidification filtrate 50 is cocurrently recycled to the $E_o$ stage pulp or to a point further downstream thereof in order to avoid the precipitation of salts in the equipment to which that filtrate was previously recycled. Filtrate portion 51 is generated by the difference in consistency of the pulp exiting wash press 34 and that exiting displacement press 48 and chemical and water addition, and must be discharged or directed to another point in the process to maintain water balance in the acidification loop. In a closed bleach plant, this stream must be directed to another point in the process. Filtrate portion 51 previously was recycled to blow tank 32 for mixing with the pulp 30 which exits the oxygen reactor 26. It was found, however, that this procedure was disadvantageous in that precipitation of such salts would occur in the wash press 34 where the pulp 30, acidic filtrate portion 51 and acidic effluent 86 were combined.

In order to prevent the formation of scale from the precipitation of such salts in displacement press 48, the salt concentration of the filtrate 50 must be decreased. This is easily accomplished by the cocurrent recycle of filtrate portion 51 to a downstream location where alkaline pulp is present. The mixing of the acidic filtrate portion 51 with alkaline pulp causes the salts to become associated with the pulp fiber for removal from the system by being physically carried forward with the fiber. This causes those salts to be removed from the acidification loop, with the concentration of such salts being reduced in filtrate 50. The precipitation problem in displacement press 48 is then eliminated or substantially reduced since the concentration of such salts in the process fluid is reduced below the precipitation point. Furthermore, when the effluents used for washing the ozone bleached pulp are neutralized by the addition of alkaline material as explained above, the introduction of salts into the acidification loop is reduced, with the concentration of such salts being further reduced. Conducting both a cocurrent recycle of filtrate portion 51 in addition with a neutralization of the ozone bleached pulp portion of the system is thus advantageous for optimum elimination of salt scale precipitation.

One location where the acidic filtrate portion 51 may be introduced is into extraction tower 92. As noted above, the pulp and effluents in this tower 92 are alkaline, so that the salts will associate with the pulp. Filtrate portion 51 may be added directly to tower 92, but it is preferred to add this filtrate portion to the portion 99A of effluent 98 which is introduced into tower 92. This allows the filtrate portion 51 to mix with the alkaline effluent portion 99A before mixing with the additional alkaline streams and pulp in tower 92.

Another location where acidic filtrate portion 51 may be introduced is into portion 99B of effluent 98 which is introduced into pulp stream 94 after the pulp has exited the tower. Alternatively, acidic filtrate portion 51 may be introduced directly into pulp stream 94 or even to pulp stream 88. Depending upon the operation of ozone bleached pulp washer, pulp stream 88 may be acidic or alkaline, but tower 92 is highly alkaline and causes the salts to associate with the pulp. As noted above, a mixing chest or other appropriate apparatus can be used, if desired, to combine filtrate portion 51 with the 99A, effluent 99B, pulp stream 92 or pulp stream 94. These additions can also be made by making a connection in the effluent or pulp stream piping for introduction of filtrate portion 51.

It is possible to cocurrently direct filtrate portion 51 to any subsequent point in the process where the pulp and filtrate stream is alkaline. For example, where multiple peroxide brightening stages are used, filtrate portion 51 could be recycled to the towers or washing equipment for either stage. Preferably, filtrate portion 51 would be introduced prior to a final brightening or bleaching stage. If desired, filtrate portion 51 could be cocurrently directed to a subsequent acid treatment stage in the same manner described above. This could occur, for example, in a ZEZEP sequence where each Z stage is conducted under acidic conditions. Filtrate portion 51 could then be directed to any of the subsequent towers or washers.

To help control the concentration of such salts in acid filtrate 50, it is useful to introduce fresh water or filtrate 72 into the filtrate loop. Then, a relatively larger quantity of filtrate portion 51 is removed for cocurrent recycle as noted above. Typically, only about 1 to 10 percent of filtrate 50 is removed as filtrate portion 51. When fresh water or filtrate 72 is added, the quantity of filtrate portion 51 increases to about 10 to 20 percent. For the situation where the consistency of the pulp exiting wash press 34 is about the same as that exiting displacement press 48, adding fresh water or filtrate 72 helps generate a filtrate portion 51 that can be removed to control the concentration of salts in the acidification loop.

As noted above, the preferred bleaching sequence is the $O_mZ_mED$ process which is described in the '043 patent. Of course, numerous variations to this process can be made. For example, the ozone delignification stage can be carried out at medium consistency rather than the preferred high consistency. If desired, a peroxide stage can precede the oxygen or ozone stages. Also, the final bleaching stage can use a peroxide instead of chlorine dioxide in order to obtain a fully chlorine free process wherein the effluent from washing the fully bleached pulp can also be recycled countercurrently to wash the pulp without treatment to remove chlorides. Also, the E stage can be enhanced with oxygen, peroxide or both.

The recycle of the effluent can be as described in the '043 patent. A fully countercurrent recycle can be used when the final brightening stage is a peroxide or is chlorine dioxide which has been treated to remove chlorides. Alternatively, portions of the effluents from subsequent stages can be recycled to preceding stages in any manner desired or devised by those persons skilled in the art.

The present invention should be applicable to any process wherein the effluent from the washing of pulp which has been subjected to a subsequent acidic pulp treatment is recycled to a preceding alkaline pulp treatment step in order to prevent the formation of salt precipitates and the resultant scale formation. For example, when acidic pulp treatments other than ozone are used, the effluents from those treatments could be handled in essentially the same manner as the acidic filtrates of the preferred ozone treatment.

EXAMPLES

The following examples provide illustrations of the preferred modes of carrying out the processes of the present invention without limiting its scope.

Example 1

A pulp bleaching sequence incorporating the use of ozone has been implemented on a 1000 ADTPD commercial scale. The bleaching sequence is an $O_mZ_mE_oD$ sequence which incorporates full countercurrent flow of effluents from the $E_o$ stage back through brownstock washing and ultimately to the liquor recovery system. As described above and in U.S. Pat. No. 5,164,043, the $O_m$ and $E_o$ stages are operated under alkaline conditions (pH 10–12), and the $Z_m$ stage is operated under acidic conditions (pH 2–3).

When full countercurrent flow of effluents is practiced, it has been observed that substantial scaling in the form of calcium and barium oxalates occurs in the post-oxygen washing equipment, particularly in the wash water inlets. The extent of scaling required cleaning of the equipment on a regular basis to maintain an operable process.

It was discovered that raising the pH of the normally acidic $Z_m$ stage washer filtrate to a pH of 8 to 9 inhibited the formation of calcium and barium oxalate scaling on the post-oxygen washing equipment by allowing the salts to associate with the pulp. Thus, an operable process could be maintained with infrequent (or no) cleaning required, while permitting full countercurrent flow of washing effluents.

Example 2

The pulp bleaching sequence of Example 1 uses an acidification step for reducing the pH of the pulp prior to the $Z_m$ stage. Since the consistency of the pulp entering the $Z_m$ reactor is higher than that which exits the post-oxygen washer, a portion of the acidification filtrate is countercurrently recycled. Since this stream was recycled to a point upstream of the acidification step, calcium and barium salts were not removed and continued to build up in this step. It was observed that substantial scaling in the form of calcium and barium sulfates also occurs in the acidification step wash press, particularly inside the drain holes where the wash water would be removed. The extent of scaling required cleaning of the equipment on a regular basis to maintain an operable process.

It was discovered that by adding a low ion concentration stream to the acidification step thereby increasing the acid filtrate portion and recycling the acid filtrate cocurrently to the $E_o$ tower, more calcium and barium ions are contacted with the pulp, and are removed from the filtrate by association With the pulp. Fresh water was used as the low ion concentration stream, although other sources, such as stripped condensate, ozone stage filtrate and the like, can be used. An overall filtrate balance was maintained by accordingly decreasing the E washer fresh water addition. Thus, an operable process could be maintained with infrequent (or no) cleaning of scale from the press.

Also, the reduction of concentration of these salts from the acidification step similarly reduced the amounts which were introduced into the post-oxygen washer due to the previous countercurrent recycle of the acidic filtrate portion. The cocurrent redirection of this filtrate portion thus assists in permitting full countercurrent flow of washing effluents without generating substantial scaling of the post-oxygen washer.

While the preceding examples have specifically illustrated the operability of the present process to prevent the formation of calcium and barium salt scale formation, the same principles are believed to apply to other compounds which are in alkaline filtrates and which can precipitate when contacting such filtrates. Thus, scale which results from precipitates of such other compounds can be prevented by following the principles and disclosure presented herein.

What is claimed is:

1. A method for reducing or eliminating the formation of salt scale upon process equipment caused by precipitation of salts during the bleaching of pulp which comprises:

subjecting the pulp to a bleaching sequence which includes a plurality of pulp treatment steps, wherein at least one pulp treatment step is conducted under alkaline conditions and at least one pulp treatment step is conducted with ozone under acidic conditions;

generating an acidic filtrate stream which contains salts therein by washing or pressing the pulp after the acidic ozone treatment step;

combining at least a portion of the filtrate stream with a caustic material and pulp to cause the salts to associate with the pulp, thus removing the salts from the filtrate stream to reduce or eliminate the formation of salt scale upon process equipment during the bleaching of the pulp; and directing the pulp and associated salts to at least one subsequent bleaching or brightening step.

2. The method of claim 1 wherein the caustic material is an alkaline stream.

3. The method of claim 1 wherein the caustic material is added to the filtrate stream portion prior to combining the filtrate stream with pulp.

4. The method of claim 1 wherein the pH of the acidic filtrate stream portion is raised to at least 6 by the addition of the caustic material before the filtrate stream portion is combined with the pulp.

5. The method of claim 1 wherein the acidic filtrate stream portion is initially mixed with the pulp and the pH of the mixture is then raised to at least 6 by the addition of the caustic material to promote salt association with the pulp.

6. The method of claim 1 wherein the acidic filtrate stream portion is neutralized by raising the pH to above about 7 with the addition of caustic material prior to countercurrently recycling the neutralized filtrate for mixing with the pulp.

7. The method of claim 1 wherein the concentration of salt cations or anions in the acidic filtrate stream is reduced by cocurrently recycling the filtrate stream portion to an alkaline portion of the process containing the caustic material prior to mixing with the pulp.

8. The method of claim 7 wherein the acidic filtrate stream portion is recycled to an alkaline effluent stream containing the caustic material prior to combining with the pulp.

9. The method of claim 7 wherein the acidic filtrate stream portion is recycled to an alkaline pulp stream containing the caustic material and the pulp to promote salt association with the pulp.

10. The method of claim 1 wherein the bleaching sequence is in a closed bleach plant where substantially all wash water effluents or filtrates are countercurrently recycled.

11. The method of claim 1 wherein a diluent stream comprising water is added to the acidic filtrate stream which contains the salts before mixing the filtrate stream with the alkaline material and pulp.

12. The method of claim 11 wherein the diluent stream is a low ion concentration stream.

13. The method of claim 12 wherein the diluent stream is fresh water, stripped condensate or ozone stage filtrate.

14. A method for reducing or eliminating the formation of salt scale upon process equipment caused by precipitation of salts during the bleaching of pulp which comprises:

subjecting the pulp to a bleaching sequence which includes a plurality of pulp treatment steps, wherein at least one pulp treatment step is conducted under alkaline conditions and at least one subsequent pulp treatment step is conducted with ozone under acidic conditions;

generating an acidic filtrate stream which contains salts therein by washing or pressing the pulp after the acidic ozone treatment step;

recycling at least a portion of the acidic filtrate stream for combining with a caustic material and pulp to cause the salts to associate with the pulp, thus removing the salts from the filtrate stream to reduce or eliminate the formation of salt scale upon process equipment during the bleaching of the pulp; and directing the pulp and associated salt to at least one subsequent bleaching or brightening step.

15. The method of claim 14 wherein the caustic material is an alkaline stream.

16. The method of claim 14 wherein the pH of the acidic filtrate stream portion is increased by mixing with the caustic material to form a mixture prior to recycling the mixture to the pulp for mixing therewith.

17. The method of claim 16 wherein the pH of the acidic filtrate stream portion is increased to at least 6.

18. The method of claim 16 wherein the pH of the acidic filtrate stream portion is increased to at least about 7 prior to recycling the mixture to the pulp.

19. The method of claim 16 wherein the pH of the acidic filtrate stream portion is increased by adding the caustic material to a washing unit which washes the acidic pulp to generate a higher pH filtrate stream before the stream portion is combined with the pulp.

20. The method of claim 19 wherein the pH of the acidic filtrate stream is increased by adding the caustic material to the water used to wash the acidic pulp in the washing unit.

21. The method of claim 14 wherein the pH of the acidic filtrate stream portion is increased by the addition of caustic material after recycling the stream and mixing the pH increased stream with the pulp.

22. The method of claim 21 wherein the acidic filtrate stream portion is recycled to an alkaline effluent stream containing the caustic material prior to combining the mixture with pulp.

23. The method of claim 21 which further comprises recycling the acidic filtrate stream portion to an alkaline pulp stream to promote salt association with the pulp.

24. The method of claim 14 wherein the pulp is acidified prior to the ozone treatment to a pH of between 1 and 4.

25. The method of claim 14 wherein the acidic filtrate portion is recycled to wash the pulp prior to the ozone treatment prior the being combined with the caustic material and the pulp.

26. The method of claim 14 wherein the alkaline pulp treatment step comprises an oxygen treatment.

27. The method of claim 26 wherein the acidic filtrate portion is recycled to wash the pulp after the oxygen treatment for mixing with the pulp and alkaline material of that treatment.

28. The method of claim 14 wherein the salts comprises calcium or barium cations and the pH is increased to at least about 7.

29. The method of claim 14 wherein the pulp which is combined with the alkaline material and acidic filtrate stream is pulp which has been subjected to at least one treatment step of the bleaching sequence.

30. A method for reducing or eliminating the formation of salt scale upon process equipment caused by precipitation of salts during the bleaching of pulp which comprises:

subjecting the pulp to a bleaching sequence which includes a plurality of pulp treatment steps, wherein at least one pulp treatment step is conducted under alkaline conditions and includes an alkaline oxygen delignification stage, at least one pulp treatment step is conducted under acidic conditions and includes an acidic ozone delignification stage, and a final pulp treatment step includes a brightening stage;

washing or pressing the pulp after the acidic ozone delignification stage, thus generating a filtrate stream which contains salts therein;

combining at least a portion of the filtrate stream with a caustic material and pulp which has been subjected to at least one treatment step of the bleaching sequence to cause the salts to associate with the pulp, thus removing the salts from the filtrate stream to reduce or eliminate the formation of salt scale upon process equipment during the bleaching of the pulp; and subsequently treating the pulp with associated salts in a brightening stage.

31. The method of claim 30 wherein the caustic material is an alkaline process stream.

32. The method of claim 30 wherein the acidic filtrate stream portion is generated by washing the pulp after the ozone delignification stage and the pH of the acidic filtrate stream portion is increased by adding caustic material to the pulp after the ozone delignification stage.

33. The method of claim 32 wherein a portion of the caustic material is added to the acidic ozone delignified pulp before the pulp is washed to increase the pH of the resulting filtrate stream.

34. The method of claim 30 wherein the brightening stage is a chlorine dioxide or peroxide stage.

35. The method of claim 34 wherein the pulp with associated salts is added to an alkaline extraction prior to the brightening stage.

36. The method of claim 35 wherein the acidic filtrate stream portion is recycled cocurrently for combining with the caustic and pulp in an alkaline stream downstream of the ozone delignification stage.

37. The method of claim 36 wherein the acidic filtrate stream portion is added to an alkaline effluent stream containing the caustic material to form a mixture prior to combining the mixture with the pulp.

38. The method of claim 36 wherein the caustic material and pulp is an alkaline pulp stream.

39. The method of claim 30 wherein the oxygen and ozone delignification stages are each conducted on high consistency pulp.

40. The method of claim 39 wherein the pH of the acidic filtrate stream portion is increased to at least 6 by the addition of the caustic material prior to combining with pulp.

41. The method of claim 40 wherein the salts comprise calcium or barium cations and the pH of the acidic filtrate stream portion is increased to at least about 7.

42. The method of claim 30 wherein the pulp with associated salts is washed after the brightening stage and the resultant wash water is recycled countercurrently to wash pulp exiting a bleaching stage.

43. A method for reducing or eliminating the formation of salt scale upon process equipment caused by precipitation of salts during the bleaching of pulp in a continuous pulp processing stream which comprises:

subjecting the pulp stream to a bleaching sequence which includes a plurality of pulp treatment steps, wherein at least one pulp treatment step is conducted under alkaline conditions and at least one pulp treatment step is conducted with ozone under acidic conditions;

generating a filtrate stream which contains salts therein by washing or pressing the pulp after the acidic ozone treatment step;

combining at least a portion of the filtrate stream with a caustic material and the pulp stream to cause the salts to associate with the pulp, thus removing the salts from the filtrate stream to reduce or eliminate the formation of salt scale upon process equipment during the bleaching of the pulp; and directing the pulp and associated salts to at least one subsequent bleaching or brightening step.

* * * * *